US012565780B2

(12) United States Patent
Mccarthy et al.

(10) Patent No.: US 12,565,780 B2
(45) Date of Patent: Mar. 3, 2026

(54) BRICK GUARD

(71) Applicant: J. MAC SAFETY SYSTEMS LIMITED, Stockton-on-Tees (GB)

(72) Inventors: Luis Mccarthy, Stockton-on-Tees (GB); Liam Eley, Stockton-on-Tees (GB)

(73) Assignee: J. MAC SAFETY SYSTEMS LIMITED, Stockton-on-Tees (GB)

( * ) Notice: Subject to any disclaimer, the term of this patent is extended or adjusted under 35 U.S.C. 154(b) by 1001 days.

(21) Appl. No.: 17/297,865

(22) PCT Filed: Dec. 19, 2019

(86) PCT No.: PCT/GB2019/053624
§ 371 (c)(1),
(2) Date: May 27, 2021

(87) PCT Pub. No.: WO2020/128483
PCT Pub. Date: Jun. 25, 2020

(65) Prior Publication Data

US 2022/0010567 A1 Jan. 13, 2022

(30) Foreign Application Priority Data

Dec. 19, 2018 (GB) ..... 1820716

(51) Int. Cl.
*E04G 5/14* (2006.01)
*E04G 21/32* (2006.01)

(52) U.S. Cl.
CPC ..... *E04G 5/145* (2013.01); *E04G 21/32* (2013.01); *E04G 2005/148* (2013.01)

(58) Field of Classification Search
CPC ... E04G 5/145; E04G 2005/148; E04G 21/24; E04G 21/32; E04G 21/3209; E04G 2005/2007; E04G 2005/285
See application file for complete search history.

(56) References Cited

U.S. PATENT DOCUMENTS 9,051,746 B2 * 6/2015 Rogers ..... E04G 5/08
2005/0189173 A1 * 9/2005 Becker ..... E04G 5/141 182/113

(Continued)

FOREIGN PATENT DOCUMENTS

CN 205577453 U 9/2016
DE 2225879 A * 5/1972

(Continued)

OTHER PUBLICATIONS

GB Search Report for corresponding UK patent application No. GB1820716.7, dated Jun. 10, 2019.

(Continued)

*Primary Examiner* — Colleen M Chavchavadze
(74) *Attorney, Agent, or Firm* — Notaro, Michalos & Zaccaria P.C.

(57) ABSTRACT

A brick guard for use with a scaffolding system, the brick guard is made from a panel with upper and lower edges and at least one clip for engaging a toe board is disclosed. The toe board clip(s) are provided at a lower part of the panel. The brick guard also has at least one clasp for engaging with a scaffolding member, where each clasp is provided at an upper edge of the panel. The brick guard may also have at least one rib projecting from a first face of the panel, wherein the rib defines a channel on a second opposing face of the (Continued)

panel. Each clasp may have at least one strut member and a leaf member connected to the strut member(s), wherein the leaf member is substantially hemicylindrical.

19 Claims, 8 Drawing Sheets

(56) References Cited

U.S. PATENT DOCUMENTS

| | | | | |
|---|---|---|---|---|
| 2007/0170411 | A1* | 7/2007 | Ribak | E01F 13/022 256/32 |
| 2007/0272908 | A1* | 11/2007 | Sotillos | E04H 17/161 256/35 |
| 2010/0294591 | A1* | 11/2010 | Leadbeater | E04G 5/14 182/112 |
| 2012/0047712 | A1* | 3/2012 | Miranda | E04G 5/12 29/283 |
| 2014/0124723 | A1* | 5/2014 | Gill | E04H 17/161 24/458 |
| 2014/0318891 | A1* | 10/2014 | Crothers | E04G 5/067 182/113 |
| 2015/0292170 | A1* | 10/2015 | Cochrane | E01F 13/022 256/13.1 |
| 2018/0058094 | A1* | 3/2018 | Filiba | E04H 17/168 |
| 2018/0112420 | A1* | 4/2018 | Hayman | E04G 7/26 |
| 2019/0186157 | A1* | 6/2019 | Melic | F16B 31/04 |
| 2019/0284815 | A1* | 9/2019 | Schlipper | E04G 21/32 |
| 2022/0162864 | A1* | 5/2022 | Skelton | E04G 5/145 |

FOREIGN PATENT DOCUMENTS

| | | | | | |
|---|---|---|---|---|---|
| DE | 20202659 | U1 | * | 5/2002 | E04G 5/14 |
| DE | 102012216681 | A1 | * | 3/2014 | E04G 5/12 |
| EP | 0098328 | A1 | | 1/1984 | |
| EP | 1072736 | A1 | * | 1/2001 | E04G 21/3214 |
| GB | 2418701 | A | | 4/2006 | |
| GB | 2445815 | A | | 7/2008 | |
| GB | 2449559 | A | * | 11/2008 | E04G 5/14 |
| GB | 2497560 | A | * | 6/2013 | E04G 5/14 |
| GB | 2556628 | A | * | 6/2018 | E04G 21/32 |
| KR | 20160002284 | U | | 7/2016 | |
| WO | WO-2012142645 | A1 | * | 10/2012 | E04F 11/1855 |
| WO | WO-2014033423 | A2 | * | 3/2014 | E04G 5/14 |
| WO | WO-2018033747 | A1 | * | 2/2018 | E04G 5/14 |
| WO | WO-2018091878 | A1 | * | 5/2018 | E04G 21/32 |
| WO | WO-2018095371 | A1 | * | 5/2018 | E04F 11/1817 |

OTHER PUBLICATIONS

GB Search Report for corresponding UK patent application No. GB1918851.5, dated Jun. 10, 2020.

International Search Report and Written Opinion for corresponding PCT application No. PCT/GB2019/053624, mailed Apr. 8, 2020.

* cited by examiner

BRICK GUARD

Another safety feature typically fitted to scaffolding platforms is a toe board, which comprises a substantially vertical barrier at the external edge of the platform. This prevents objects, typically tools, from rolling off the platform. This increases safety for workers (or others) passing beneath the platform.

TECHNICAL FIELD OF THE INVENTION

The present invention relates to a brick guard for use with scaffolding and in particular to a brick guard suitable for use with modular system scaffolding.

BACKGROUND TO THE INVENTION

Scaffolding is a temporary structure used to support a work crew and materials to aid in the construction, maintenance and repair of buildings and the like. Scaffolding is widely used to provide workers with ready access to parts of the building that would otherwise be out of reach.

Scaffolding typically comprises a frame made up of members described as standards, ledgers and transoms, secured together by couplers or clamps. The standards are upright members operable to transfer the entire weight of the structure to the ground. Typically, the lower end of the standards may rest on a base plate or the like. Ledgers are horizontal members which connect between the standards. Transoms are horizontal members that rest upon the ledgers. Transoms provide support for horizontal boards. Such boards provide a scaffolding platform upon which workers can stand or move as they access parts of the building.

For the safety of workers on scaffolding platforms, it is usual to provide one or more guard rails. The guard rails are horizontal members connected between standards. The guard rails are provided at a suitable height above the platform and at the external side of the scaffolding to inhibit the prospect of a worker falling off the platform.

Another safety feature typically fitted to scaffolding platforms is a toe board, which comprises a substantially vertical barrier at the external edge of the platform. This prevents objects, typically tools, from rolling off the platform. This increases safety for works (or others) passing beneath the platform.

Where building materials, such as bricks, are stored on the platform in advance of use on the building, the combination of the guard rails and toe board may not provide adequate protection against the possibility of such objects falling from the platform. In such circumstances, it is common to provide a brick guard. The brick guard typically comprises a panel which can be fitted between the guard rails and the toe board to prevent objects from falling through the gap between the guard rails and toe board. In many instances the brick guard panel has a lattice structure, the gaps in the lattice being smaller than a brick or other object expected to present a falling hazard. This minimises wind resistance of the panel and thus protects the scaffolding from exposure to additional structural strain.

In some countries, it is typical to construct scaffolding from what is known as a tube and coupler system. This comprises a plurality of tubular members and a plurality of right-angle clamps. Scaffolding can thus be constructed with couplings between members at any position along the members. Such systems are versatile but do require a level of skill and judgement to erect safely.

In other territories, it is more common to use modular system scaffolding or ring type system scaffolding. Examples of such systems include but are not limited to those supplied by Haki, Cuplock, Peri, Plettac, and Layher. Such systems comprise a plurality of members with integral connector formations at specific positions and corresponding connector fittings for engaging with the connector formations. As a result, the members can only fit together in specified configurations. This has a benefit in simplifying construction, albeit at the cost of versatility. System scaffolding is typically proprietary and thus the connector formations and fittings are not compatible with rival systems and/or with tube and coupler scaffolding.

The above applies equally to related components such as brick guards. In particular, brick guards designed for use with tube and coupler scaffolding are not able to accommodate connector formations on members used in modular system scaffolding. Accordingly, users of such system scaffolding are obliged to use brick guard panels specifically designed for use with the selected scaffolding system.

For convenient transport and storage, it is desirable that brick guards can be readily stacked. Whilst this is readily achieved for the panel portion of the brick guard, it can be difficult to provide means for engaging the panel with a guard rail that engages securely and are readily stacked.

It is therefore an object of the present invention to provide a brick guard suitable for use with a modular scaffolding system that at least partially overcomes or alleviates the above issues.

SUMMARY OF THE INVENTION

According to the present invention there is provided a brick guard for use with a scaffolding system, the brick guard comprising: a panel having, in use, upper and lower edges; at least one clip for engaging a toe board, the at least one clip provided at a lower part of the panel; and at least one clasp for engaging with a scaffolding member, the at least one clasp provided at an upper edge of the panel.

The combination of one or more toe board clips and one or more scaffolding member clasps ensure secure fixing of the brick guard to the scaffolding in all conditions.

The brick guard may also comprise at least one rib projecting from a first face of the panel, the rib defining a channel on a second opposing face of the panel.

The channel defined by the rib of the present invention thus provides space to accommodate connector fittings of modular scaffolding systems without impacting on the fundamental function of the panel. Accordingly, the brick guard of the present invention is suitable for use with both modular scaffolding and tube and coupler scaffolding.

The brick guard may be formed of any suitable material. In one embodiment, the brick guard may be formed of a suitable metal. In such embodiments, the brick guard may be formed from sheet metal. In other, more preferred embodiments, the brick guard may be formed of a suitable plastic. Plastics are typically preferred as they are lighter and cheaper than metal. Furthermore, plastic panels may be more readily coloured which can be beneficial from both a safety (visibility) purpose and from a branding perspective. In such embodiments, the brick guard may be formed by moulding a suitable plastic. Suitable plastics include but are not limited to low density polyethylene (LDPE), high density polyethylene (HDPE), polypropylene or the like.

The panel preferably has a lattice structure. This beneficially reduces the weight of the panel and lowers the wind resistance of the panel. The lattice structure may be defined by a plurality of cross-links with gaps therebetween. The positioning of cross-links and/or gaps between cross-links in the lattice structure may be determined by the requirement to accommodate integral connector formations on scaffolding members. The lattice structure may have substantially perpendicular cross-links with gaps therebetween.

The panel may be substantially rectangular. The panel may be of any suitable size to fit a scaffolding system. Typically, the panel may be of the order of 900-1000 mm from upper edge to lower edge. In one example, the panel is 945 mm from upper edge to lower edge.

The rib may comprise upper and lower projecting walls and a lateral surface. The upper and lower walls may be substantially solid. The lateral surface may have a lattice form. This can reduce wind resistance and weight. The separation of the upper and lower projecting walls and/or the extent of the projection of the upper and lower projecting walls may be determined by the requirement to accommodate integral connector formations on scaffolding members. Similarly, the position of the rib with respect to the upper and lower edges of the panel may be determined by the requirement to accommodate integral connector formations on scaffolding members. In one example, the rib is positioned at around 400 mm to 500 mm from the lower edge of the panel.

The or each clip may comprise a limb member connected to the panel by a joint member. The limb member may be offset from the panel. Typically, the limb member is offset from the panel in the opposite direction to the rib. The offset limb member in use will engage with an opposing face of the toe board to the panel. The junction member and the offset distance of the limb member may be adapted such that when the limb member is urged into engagement with the toe board. The distal end of the limb member may be angled or bevelled to facilitate the engagement of a toe board into eth clip.

The limb member may have an engaging surface opposing the panel. The limb member may have an outer surface opposite to the engaging surface. The limb member may be adapted to grip the toe board. This may be achieved by way of gripping formations provided on the engaging surface of the limb member. The limb member may be provided with one or more vanes. The vanes may be provided on the outer surface. The vanes may extend over the joint member. The vanes may provide additional structural strength to the clip.

An opening may be provided in the panel corresponding to the location of the clip. The opening may be substantially rectangular. The opening may not breach the edges of the panel. The opening may be provided such that the lower edge of the panel is continuous. The clip of an adjacent brick guard can pass through the aperture on stacking. Thus, the clip facilitates efficient stacking and storage of brick guards. Where the opening does not breach the edges of the panel, the opening provides enhanced strength to the brick guard compared with existing brick guards. In addition, the continuous lower edge of the panel is always well aligned, unlike if the opening breached the lower edge of the panel. This makes installing the brick guard easier as it is less likely to get caught on the toe board or scaffolding.

The or each clasp may be provided at a separation from the side edge of the panel. The separation distance may be determined by the requirement to accommodate integral connector formations on scaffolding members.

The clasp may comprise: a pair of struts, each strut projecting upward from the upper edge of the panel and curving outward from the plane of the panel and a leaf member positioned between said struts and curving outward from the plane of the panel in a direction opposed to the curvature of the struts. The clasp may thus be able to engage with a member, such as a guard rail positioned between the struts and the leaf member and aligned parallel to the upper edge of the panel. The curvature of the struts and leaf member may additionally facilitate ready stacking of the brick guards.

The leaf member may be provided with one or more vanes. The vanes may be provided on the convex surface. The vanes may provide additional structural strength to the leaf member.

The struts and/or leaf member may be deformable. The radius of curvature of the struts and/or leaf member may be less than the expect radius of curvature of the guard rail. This may result in the clasp being urged into secure engagement with the guard rail. The leaf member may be positioned between the struts. The top of the struts may connect to the leaf member.

In some embodiments, the struts may extend upward parallel to the plane of the panel. The struts may be rectangular. The struts may be connected to the panel by their short edge. In such embodiments, the strut may comprise an upper curved region. The upper curved region may be curved away from the plane of the panel. The upper curved section may have a smaller top edge than the bottom edge. The upper curved section may additionally curve in a direction parallel to the plane of the panel. The upper curved section may curve towards the leaf member.

The lower section of the strut may feature an abutting region. The abutting region may be shaped to define an arc with the upper curved section of the strut when viewed along the axis of the guard rail to be engaged. The arc may subtend an angle of approximately 160 degrees. The edges of the abutting region may be parallel to the plane of the brick guard panel. The centre of the abutting region may abut out of the plane of the brick guard panel. The abutting region may be hollow. Thus, the shape of the abutting region provides strength to the clasp and facilitates close stacking of brick guards.

The leaf member may be connected to the clasp by joints at the top edge of both the struts. The leaf member may be rectangular. The long edge of the leaf member may span the gap between the adjacent struts of the clasp. The leaf member may be substantially hemicylindrical in shape with uncapped ends. The abutting region, curved strut section and leaf member may define an arc when viewed along the elongate axis of a guard rail to be engaged. The arc may subtend an angle of at least 200 degrees. The abutting region, curved strut section and leaf member may co-operate to engage the guard rail.

The clasp may additionally comprise a guide member. The guide member may restrict movement of the brick guard in a direction perpendicular to the plane defined by the brick guard panel. The guide member may restrict movement of the brick guard while it is being fitted to a guard rail. The guide member may guide the guard rail into engagement with the clasp. The guide member may be attached to the leaf member.

The guide member may extend from the lower edge of the leaf member. The guide member may be substantially the same width and thickness as the leaf member. The guide member may extend away from the plane of the brick guard panel. The guide member may be shaped to facilitate ready stacking of the brick guards.

The guide member may be arcuate. The guide member may be curved in a direction opposed to the curvature of the leaf member. The guide member may define an arc subtending an angle of 90 degrees or less. The guide member and leaf member may have an integrated unibody design. In such an embodiment, the leaf member and guide member may define a sigmoidal shape. The guide member may be detachable from the leaf member. The guide member may be a different colour from the leaf member. This may allow easier visual identification of the guide member by an operator.

Where the strut features an abutting region, the abutting region may be shaped to guide the guard rail into engagement with the clasp or vice versa. The abutting region may co-operate with the guide member to guide the guard rail into engagement with the clasp. The guide member and abutting region may define converging surfaces. The surfaces may converge between the lead member and strut. Advantageously, the guide member and abutting region makes it easier to install the brick guard onto a guard rail.

The guide member may provide a handle once the guard rail is engaged in the clasp. The guide member may be used to deform the clasp. Typically, the clasp may be deformed manually by an operator using the guide member during or immediately prior to removal. Thus, the guide member also makes it easier to remove the brick guard from a guard rail. When fitting the brick guard to a guard rail, the abutting region and guide member preferably co-operate to urge resilient deformation of the leaf member and/or struts, to allow passage of scaffolding member. In an embodiment, the guide member guides the guard rail into engagement with the clasp, particularly when force is applied to the brick guard, during attachment.

According to a second aspect of the present invention, there is provided a brick guard for use with a scaffolding system, the brick guard comprising: a panel having, in use, upper and lower edges; at least one clip for engaging a toe board, the at least one clip provided at a lower part of the panel; and at least one clasp for engaging with a scaffolding member, the at least one clasp provided at an upper edge of the panel, wherein the or each clasp comprises: a pair of struts, each strut projecting upward from the upper edge of the panel; and a hemicylindrical leaf member positioned between said struts.

The clasp of the present invention thereby provides secure connection to a guard rail of varying sizes. It also facilitates the stacking of a plurality of like panels so as to enable convenient transport of the brick guards and/or convenient storage when not in use.

The brick guard of the second aspect of the present invention may include any or all features of the brick guard of the first aspect of the present invention, as desired or as appropriate.

According to a third aspect of the present invention, there is provided a brick guard for use with a scaffolding system, the brick guard comprising: a panel having, in use, upper and lower edges; at least one clip for engaging a toe board, the at least one clip provided at a lower part of the panel; at least one clasp for engaging with a scaffolding member, the at least one clasp provided at an upper edge of the panel; and, at least one rib projecting from a first face of the panel, the rib defining a channel on a second opposing face of the panel.

The rib of the third aspect of the present invention thereby facilitates the brick guard being fitted to a wide variety of modular scaffolding systems that other brick guards are not compatible with.

The brick guard of the third aspect of the present invention may include any or all features of the brick guard of the first or second aspects of the present invention, as desired or as appropriate.

According to a fourth aspect of the present invention, there is provided a scaffolding structure comprising one or more brick guards according to the first, second or third aspects of the present invention.

The scaffolding structure may be a tube and coupler scaffolding structure. The scaffolding structure may be a modular scaffolding structure. The modular scaffolding structure may be a modular scaffolding structure of the type supplied by Haki, Cuplock, Peri, Layher, Plettac or the like.

The scaffolding structure may incorporate any or all features of the brick guards of the first, second and third aspects of the present invention, as desired or as appropriate.

DETAILED DESCRIPTION OF THE INVENTION

In order that the invention may be more clearly understood one or more embodiments thereof will now be described, by way of example only, with reference to the accompanying drawings, of which:

Figure 1:
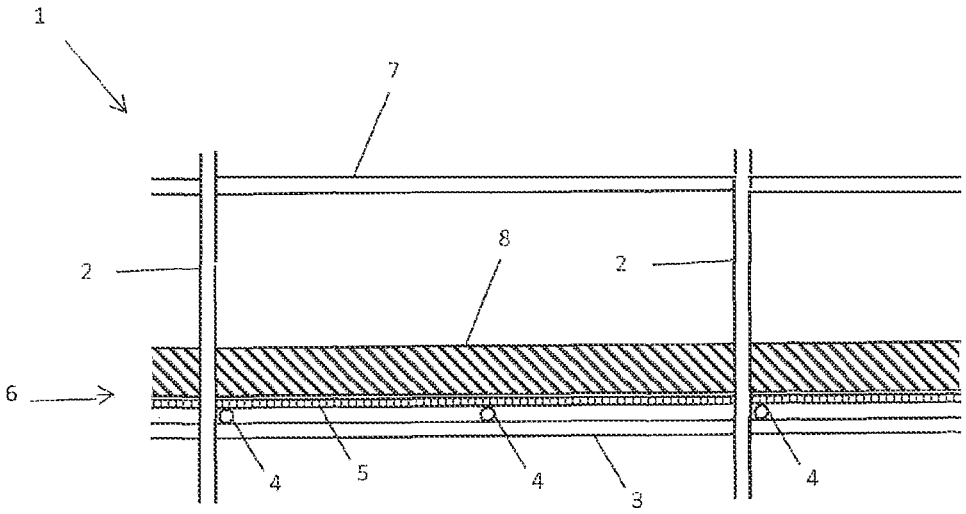
FIG. 1 is a schematic illustration of tube and coupler scaffolding to which a brick guard according to the present invention could be fitted.

Turning now to FIG. 1, a tube and coupler scaffolding structure 1 comprises: standards 2 which are upright members operable to transfer the entire weight of the structure 1 to the ground; ledgers 3 which are horizontal members which connect between the standards 2; and transoms 4 which are horizontal members that rest upon the ledgers 3. The transoms 4 provide support for horizontal boards 5 forming a scaffolding platform 6 upon which workers can stand or move.

The scaffolding structure 1 comprises a guard rail 7, being a horizontal member connected between standards 2 at a suitable height above the platform 6 to inhibit the prospect of a worker falling off the platform 6. A toe board 8, which comprises a substantially vertical barrier at the external edge of the platform 6 is also provided. This prevents objects, typically tools, from rolling off the platform 6. In this example, the toe board 8 is typically 225 mm high under UK standards. To inhibit the prospect of items falling from the platform 6 between the guard rail 7 and the toe board 8, a brick guard can be provided (not shown in FIG. 1).

Figure 2:
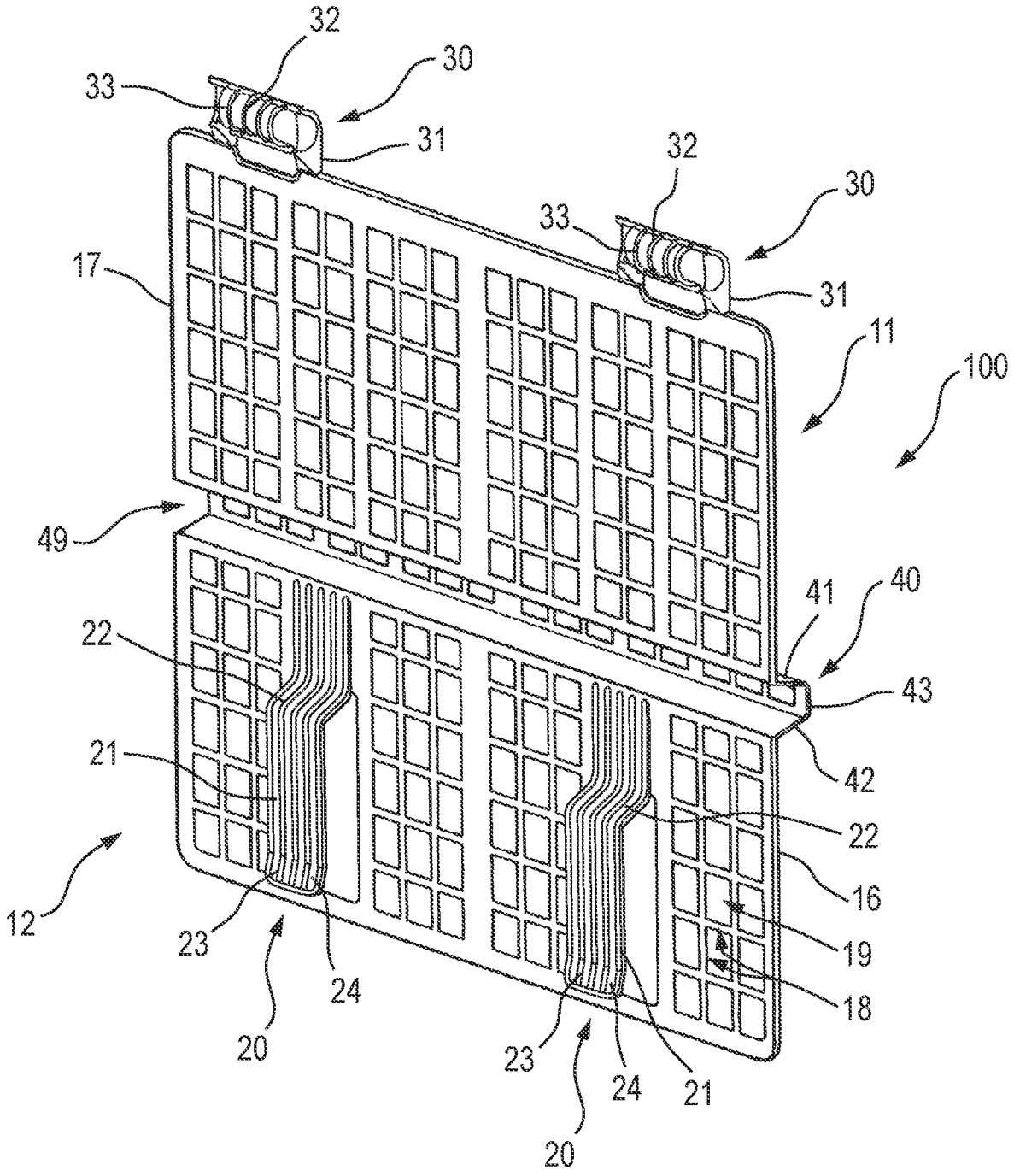
FIG. 2 is a perspective view of a brick guard according to an embodiment of the present invention.
Figure 3:
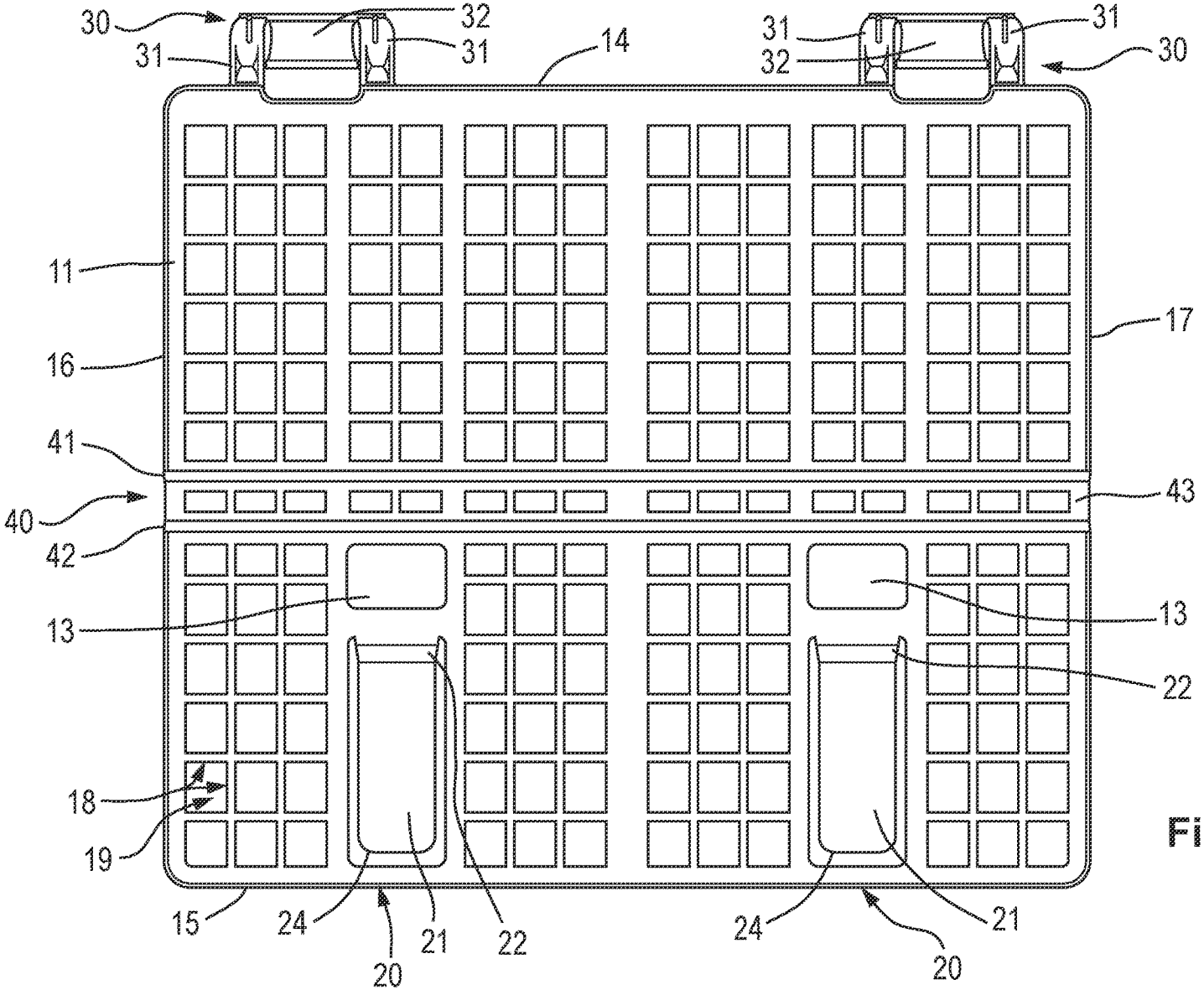
FIG. 3 is a view of a first face of a brick guard according to FIG. 2.
Figure 4:
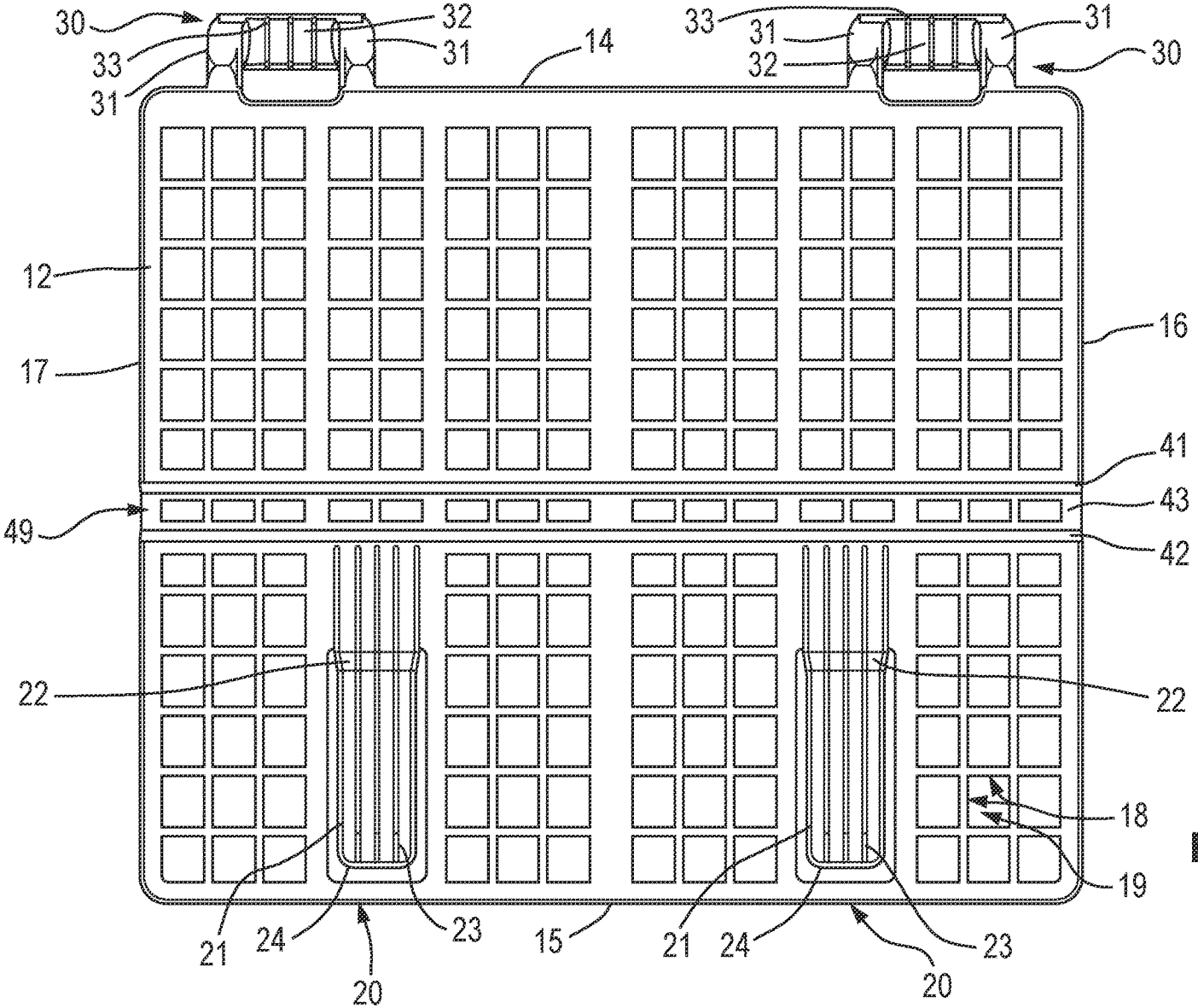
FIG. 4 is a view of second face of a brick guard according to FIG. 2.

Turning now to FIGS. 2-4, a brick guard 100 according to an embodiment of the present invention comprises a panel 10 having a lattice structure, a pair of clips 20 at a lower edge 14 of the panel 10, a pair of clasps 30 at an upper edge 15 of the panel 10 and a rib 40 projecting from a first face 11 of the panel 10 and thereby defining a channel 49 on a second opposing face 12 of the panel 10.

The panel 100 has a lattice structure with a plurality of substantially perpendicular cross-links 18 and gaps 19 therebetween.

The brick guard 100 is typically formed of plastic by an injection moulding process. Typically, the plastic may be brightly coloured to enhance visibility. In some instances, the colour may be selected for branding purposes. The panel 10 is optionally provided with display areas 13. The display areas 13 may facilitate the attachment of labels stickers or the like to convey ownership information, installation information or branding information. Alternatively, the display areas 13 can be moulded to convey such information.

The clips 20 comprise a limb member 21 connected to the panel 10 by a joint member 22, the limb member 21 being offset from the panel 10, typically in the opposite direction to the rib. The limb member 21 in use will engage with one face of the toe board 8 whilst the panel 10 engages with an opposing face of the toe board 8. to the panel. The junction member 22 is sized so as to facilitate the accommodation of the toe board 8 between the panel 10 and limb member 21. In particular, the size and shape of the junction member 22 may be selected so as to ensure that the limb member 21 is urged into engagement with the toe board 8. As toe boards 8 supplied for use in many modular scaffolding systems are in the region of 150-180 mm high, the limb members 21 are sufficiently long to securely engage with both UK standard toe boards 8, as shown in FIG. 1, and smaller modular systems toe boards 8. This ensures that the brick guard 100 can comply with wind resistance tests when used with larger or smaller toe boards 8.

The limb member 21 is provided with a sloped end 24 to facilitate the accommodation of the toe board 8. The surface of the limb member 21 and junction member 22 are provided with a series of vanes 23. These vanes 23 provide additional structural strength to the clip 20.

The clasps 30 comprise: a pair of struts 31, each strut 31 projecting upward from the upper edge 15 of the panel 10 and curving outward from the plane of the panel 10; and a leaf member 32 positioned between said struts 31 and curving outward from the plane of the panel 10 in a direction opposed to the curvature of the struts 31. The clasp 30 is able to engage with the guard rail 7. This enables the brick guard 100 to be held securely in position relative to the guard rail 7. The radius of curvature of the struts 31 and/or leaf member 32 is typically less than the radius of curvature of the guard rail 7. This results in the opposing struts 31 and leaf member 32 being urged into secure engagement with the guard rail 7.

The leaf member 32 is provided with vanes 33 may be provided on the convex surface. The vanes 33 provide additional structural strength to the leaf member 32.

The curvature of the struts 31 and leaf member 32 facilitates ready stacking of the brick guards 100 when not in use or when being transported.

The position of the claps 30 on the upper edge 15, relative to either side 16, 17 of the panel 10 is determined by the requirement to accommodate integral connector formations on scaffolding members The rib 40 comprises upper and lower projecting walls 41, 42 and a lateral surface 43. The upper and lower walls 41, 42 are substantially solid whereas the lateral surface 43 has a lattice form. This can reduce wind resistance and weight.

The separation of the upper and lower projecting walls 41, 42 and the extent of the projection of the upper and lower projecting walls 41, 42 is determined by the requirement to accommodate integral connector formations on scaffolding members. Similarly, the position of the rib 40 with respect to the upper and lower edges 15, 14 of the panel 10 is determined by the requirement to accommodate integral connector formations on scaffolding members.

Figure 5:
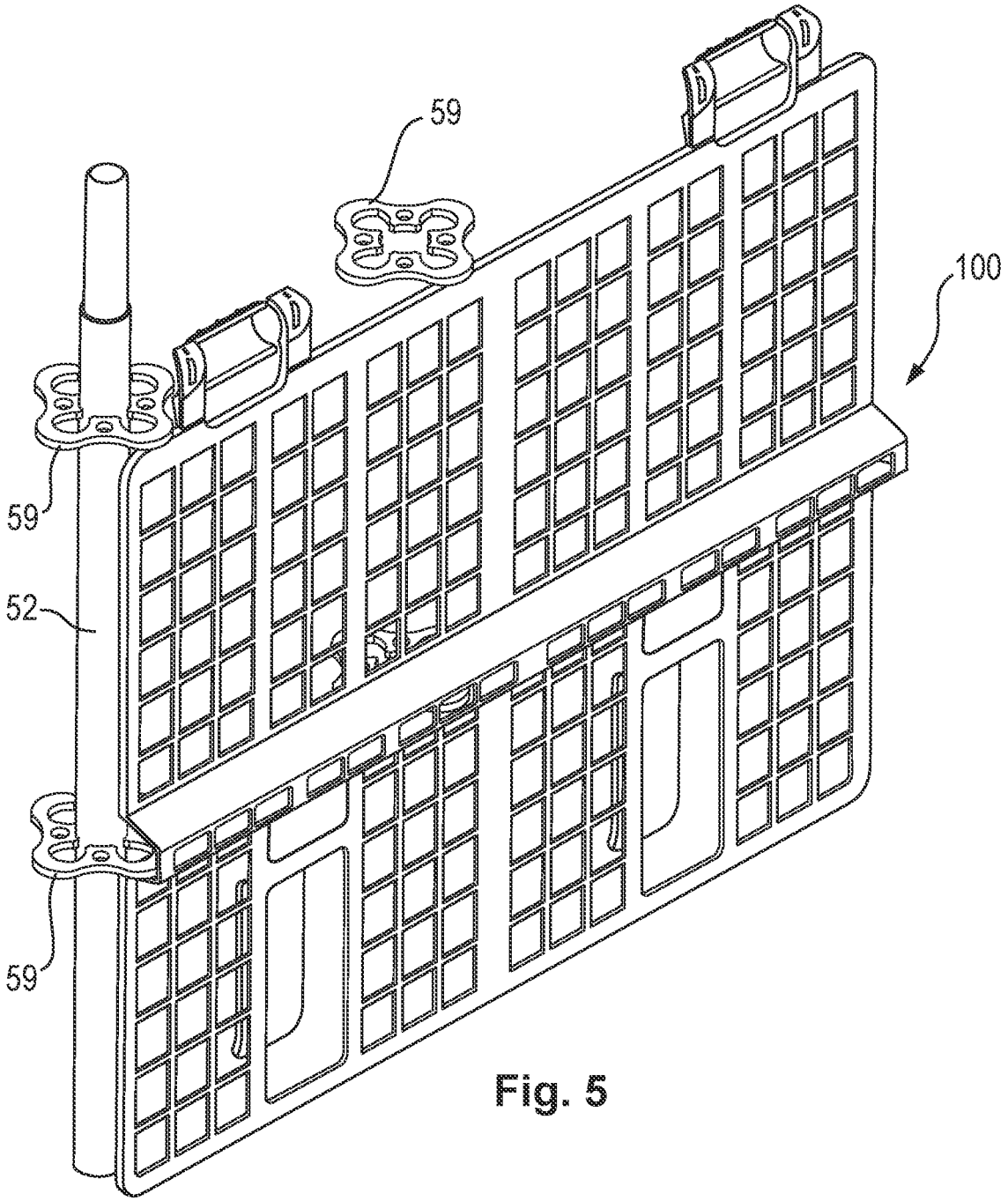
FIG. 5 is a view of a brick guard according to FIG. 2 fitted to a standard member from the Peri modular scaffolding system.

Turning now to FIG. 5, the brick guard 100 is shown fitted to a standard member 52 from the Peri modular scaffolding system 50. In the Peri system 50, the standard members 52 are provided with connector formation 59 at regular intervals. As can be seen in FIG. 5, the channel 49 defined by rib 40 readily accommodates the connector formation 59.

Figure 6:
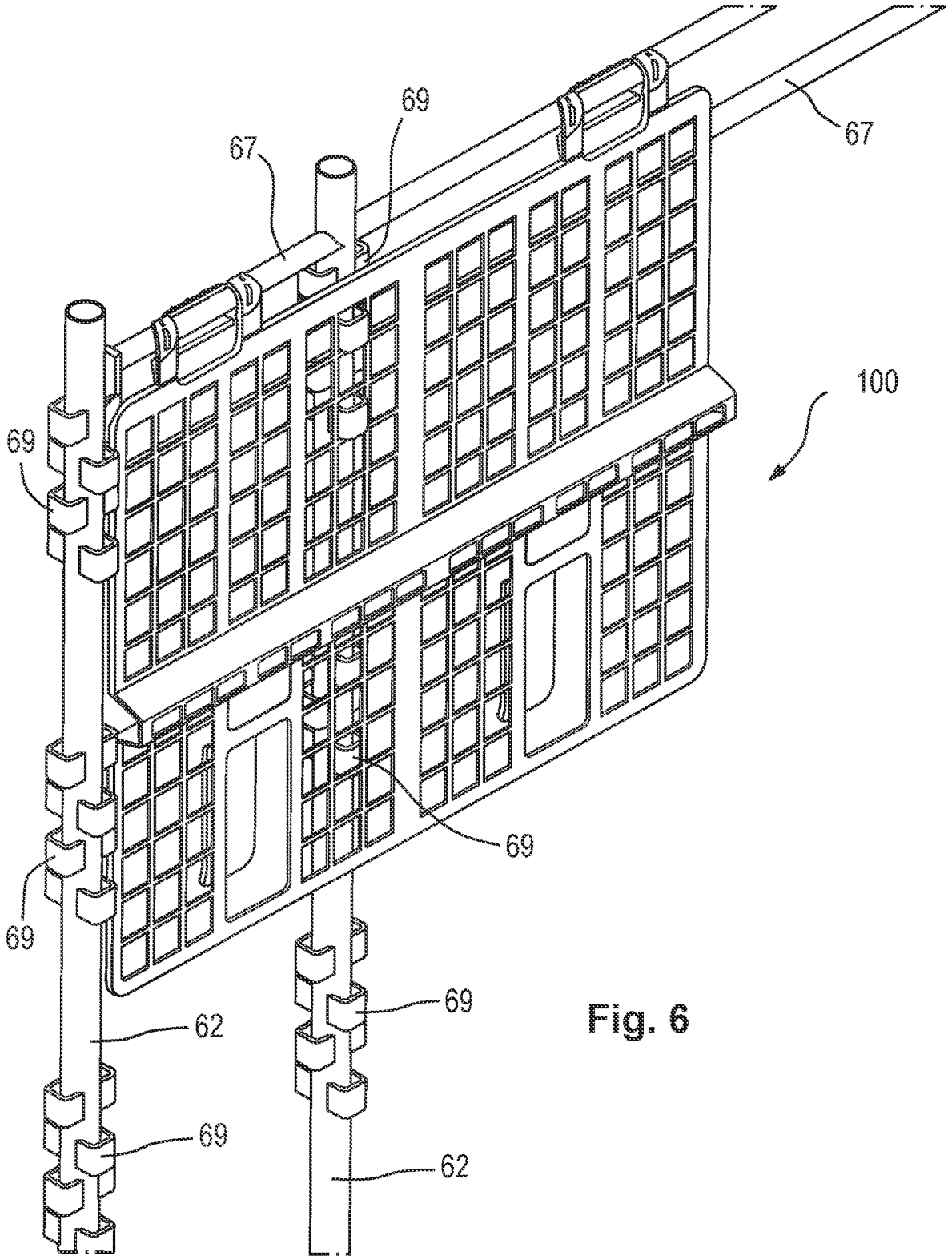
FIG. 6 is a view of a brick guard according to FIG. 2 fitted to a standard member and guard rail from the Haki modular scaffolding system.

Turning now to FIG. 6, the brick guard 100 is shown fitted to a standard member 62 and guard rail 67 from the Haki modular scaffolding system 60. In the Haki system 60, the standard members 62 are provided with connector formation 69 at regular intervals. As can be seen in FIG. 6, the channel 49 defined by rib 40 readily accommodates the connector formation 69. Additionally, the gaps 19 in the lattice structure of panel 10 are aligned to accommodate the connector formation 69.

Figure 7:
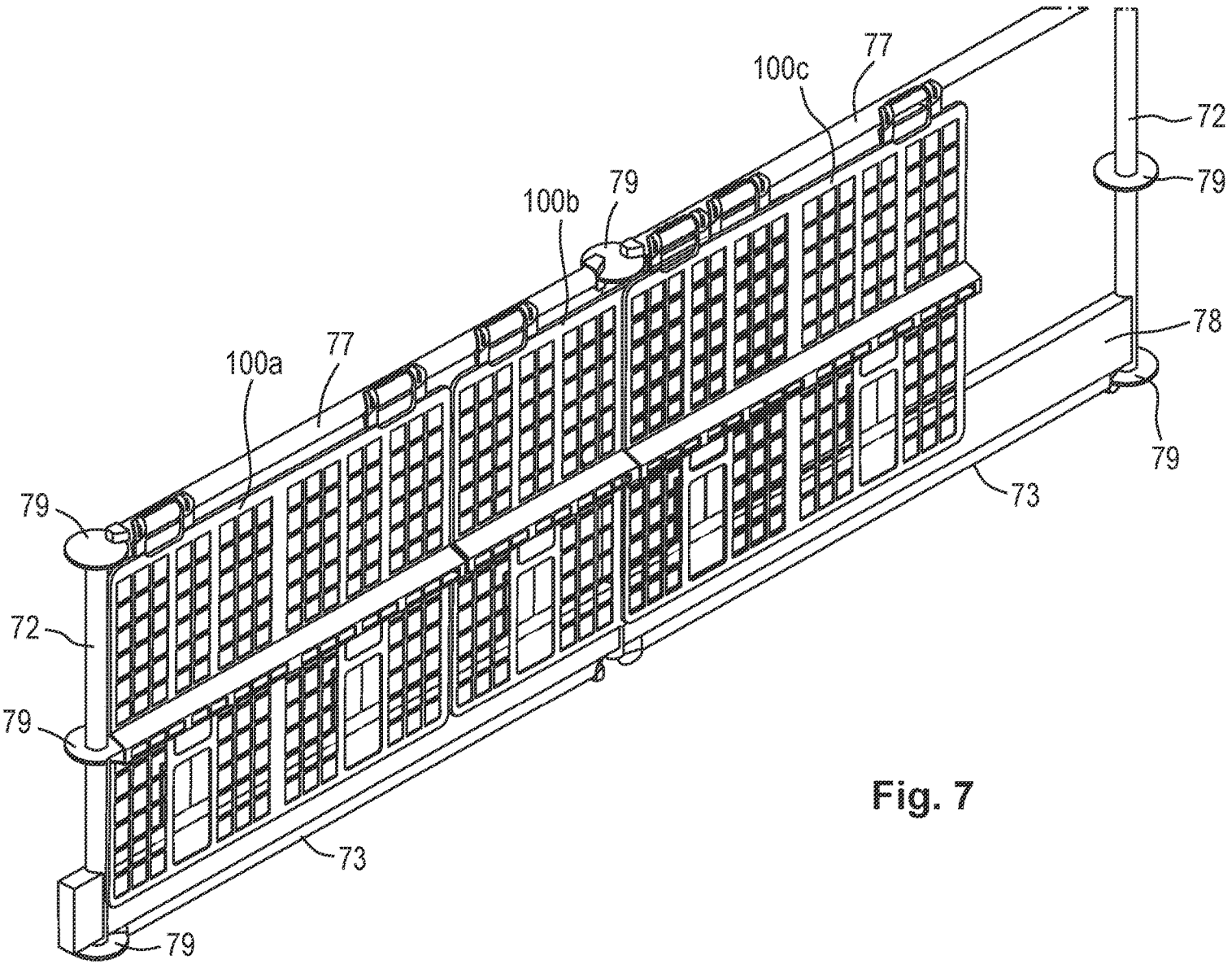
FIG. 7 is a view of a plurality of brick guards according to FIG. 2 fitted to a standard member and guard rail from a disc type modular scaffolding system.

Turning now to FIG. 7, three brick guards 100*a*-100*c* are shown fitted to standard members 72, ledger, 73, guard rail 77 and toe board 78 of a disc type modular scaffolding system 70. In the disc type system 70, the standard members 72 are provided with connector formation 79 in the form of a disc at regular intervals. As can be seen in FIG. 7, the channel 49 defined by rib 40 readily accommodates the connector formation 79. FIG. 7 further illustrates that in use panels 100 can be fitted adjacent to one another (brick guard 100*a*, 100*b*) or partially overlapping (brick guards 100*b*, 110*c*). this can facilitate the provision of access, for instance by way of a ladder or can simply facilitate providing brick guards 100 for platforms 6 of non-integer unit lengths.

Figure 8:
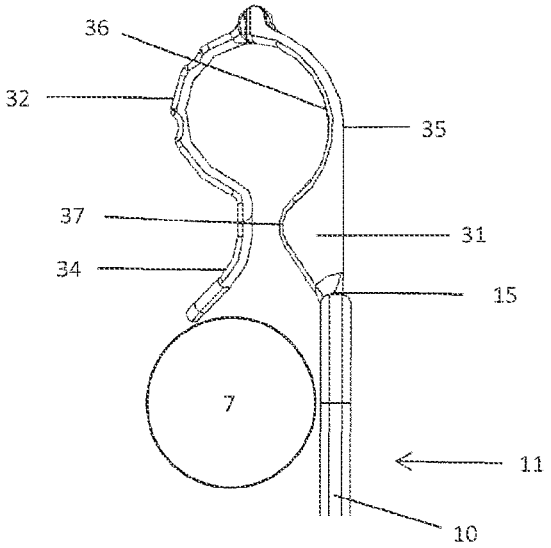
FIG. 8 is a side view of the clasp of a brick guard according to an embodiment of the present invention placed above a guard rail to be engaged by the clasp.
Figure 9:
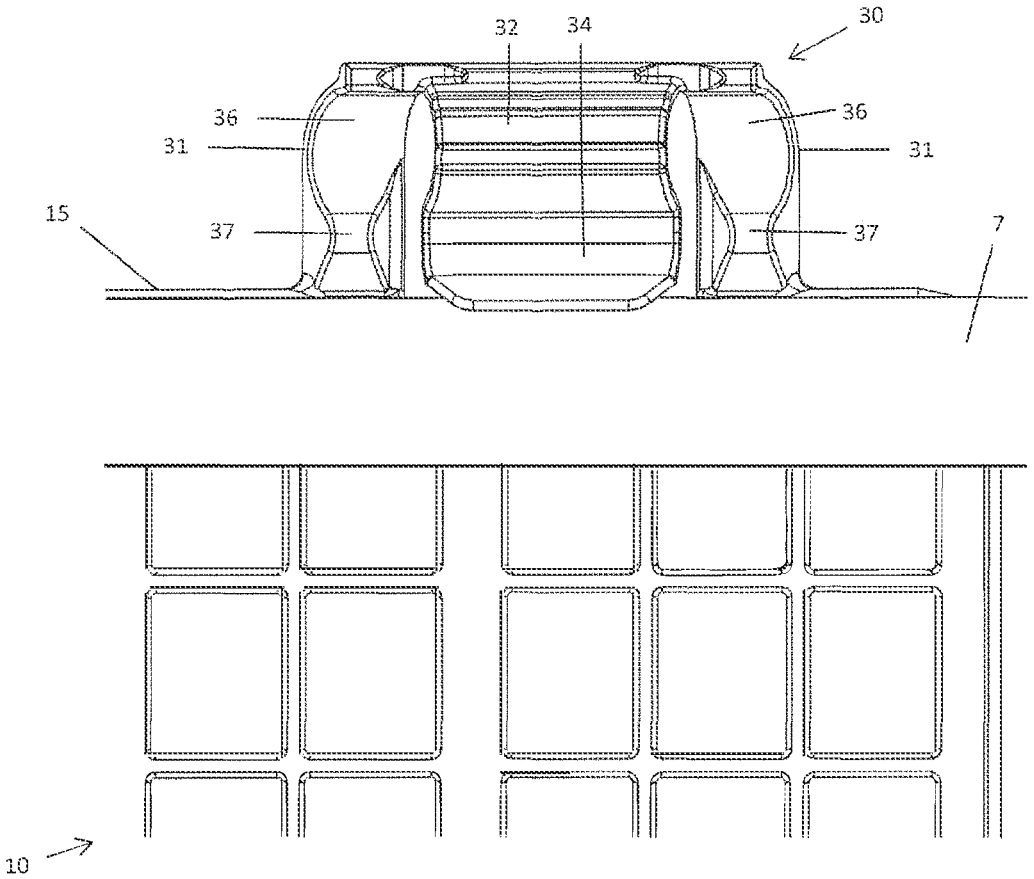
FIG. 9 is a front view of the clasp of FIG. 8.

Turning now to FIGS. 8 and 9, in an alternative embodiment, the clasps 30 comprise: a pair of struts 31; a leaf member 32, positioned between the struts, and a guide member 34.

Each strut 31 is substantially rectangular and projects upward from the upper edge 15 of the panel 10, with a short edge (width) of the strut 31 joined to the panel 10 and the long edges (length) substantially parallel with the vertical direction in use. Each strut 31 comprises a back face 35, a front face 36 and an abutting region 37. The back face 35, defining the face of the strut 31 on the same side of the panel 10 as the first face 11. The front face 36 and abutting region 37 define the opposite face of the strut 31 as the back face 35.

Working from the panel 10 upwards, the edges of the back face 35 are flat and the mid-section recesses to match the shape of the abutting region 37, which is described later. Above the abutting region 37, the back face 35 is flat across its width and curves along its length away from the plane of the panel 10 and the first face 11. The curved region of the back face 35 defining an arc that subtends an angle of approximately 90 degrees when viewed in a direction parallel to the elongate axis of the guard rail 7 to be engaged (see FIG. 8). In addition, the top of the curved region is smaller across its width than at the base, and the curved region curves gently towards the leaf member 32.

The abutting region 37 abuts the strut 31 on the opposite side of the strut 31 from the flat region of the back face 35. The front face 36 is on the concave side of the strut 31 on the curved region of the back face 35. When viewed in a direction parallel to the elongate axis of the guard rail 7 to be engaged, the front face 36 and abutting region 37 are shaped to define an arc subtending an angle of approximately 160 degrees.

The leaf member 32 is also substantially rectangular. The leaf member 32 is connected to the struts 31 at their upper edges, the long edge of the leaf member 32 spans the distance between the struts 31. The leaf member is curved to define a hemicylindrical shell, with uncapped ends. As such, when viewed in a direction parallel to the elongate axis of the guard rail 7 to be engaged, the leaf member 32 defines an arc subtending an angle of approximately 180 degrees with substantially the same radius of curvature as the arc defined by the front face 36 and abutting region 37. Thus, the leaf member 32, front face 36 and abutting region 37 define an arc subtending an angle of approximately 340 degrees. The radius of curvature of the arc being slightly less than the radius of the guard rail 7 to be engaged.

The guide member 34 extends from the lower edge of the leaf member 32 and is the same width and thickness as the leaf member 32. In this embodiment, the guide member 34 curves in a direction opposing the curvature of the leaf member 32 and therefore curves away from the plane of the panel 10. When viewed in a direction parallel to the elongate axis of the guard rail 7 to be engaged, the guide member 34 and lower portion of abutting region 37 are shaped to define surfaces converging between the strut 31 and leaf member 32.

In use, when fitting a brick guard to a guard rail 7, the converging surfaces of the guide member 34 and lower portion of the abutting region 37 guide the guard rail 7 into the clasp 30. The guard rail 7 is then engaged at the centre of circle defined by the curvature of the leaf member 32, front face 36 and abutting region 37. This makes fitting of a brick guard to a guard rail 7 much easier as movement of the brick guard panel 10 in a direction perpendicular to the plane of the panel 10 is minimised by the converging surfaces of the guide member 34 and abutting region 37. Once the guard rail 7 is engaged in the clasp 30, accidental, but not deliberate, removal of the guard rail 7 is prevented by the co-operation of the leaf member 32, front face 36 and abutting region 37 which are shaped such that the opposing faces of the strut 31 and leaf member 32 are urged into engagement with the guard rail 7. In addition, the guide member 34 advantageously provides a handle that can be used to deform the clasp 30 and facilitate easier removal of the brick guard from the guard rail 7.

The one or more embodiments are described above by way of example only. Many variations are possible without departing from the scope of protection afforded by the appended claims.

The invention claimed is:

1. A brick guard for use with a scaffolding system, the brick guard comprising:

a panel having an upper edge and a lower edge;

at least one clip for engaging a toe board, the at least one clip provided at a lower part of the panel;

at least one clasp for engaging with a scaffolding member, the at least one clasp provided at the upper edge of the panel; and at least one rib projecting from a first face of the panel, the rib defining a channel on a second opposing face of the panel, wherein the channel defined by the rib comprises:

a length parallel to the scaffolding member engaged by the at least one clasp, a depth perpendicular to the panel, and a height perpendicular to the length and the depth of the channel, wherein the length of the channel is greater than the depth of the channel, wherein each element of the brick guard is shaped to allow stacking of multiple identical brick guards in a direction perpendicular to the panel of each brick guard; and wherein an opening is provided in the panel adjacent the clip to receive the clip of an identical brick guard on stacking, wherein the opening does not breach edges of the panel and the lower edge of the panel is continuous.

2. The brick guard as claimed in claim 1, wherein the at least one clasp comprises:

a pair of struts, each strut projecting upward from the upper edge of the panel; and a hemicylindrical leaf member positioned between said struts, wherein the hemicylindrical leaf member has a shape of a hemicylinder with uncapped ends and has a curved closed wall spanning a majority of a gap between said struts, and wherein the hemicylindrical leaf member includes vanes on an outer surface thereof.

3. The brick guard as claimed in claim 2 wherein the at least one clasp is provided at a separation from a side edge of the panel to accommodate integral connector formations on the scaffolding member.

4. The brick guard as claimed in claim 3 wherein the pair of struts and the hemicylindrical leaf member are together resiliently deformable to releasably engage the scaffolding member between the pair of struts and the hemicylindrical leaf member.

5. The brick guard as claimed in claim 4 wherein each strut of the pair of struts comprises a lower abutting region and an upper curved region, and wherein the upper curved region curves away from a plane of the panel.

6. The brick guard as claimed in claim 5 wherein the upper curved region additionally curves towards the hemicylindrical leaf member.

7. The brick guard as claimed in claim 5 wherein the upper curved region is wider at a base of the upper curved region than at a top of the upper curved region.

8. The brick guard as claimed in claim 5 wherein the lower abutting region has side edges parallel to the plane of the panel and a mid-section that extends out of the plane of the panel.

9. The brick guard as claimed in claim 5 wherein the lower abutting region and the upper curved region of each strut of the pair of struts co-operate with the hemicylindrical leaf member to define an arc when viewed along an axis parallel to the scaffolding member, wherein the arc is sized to at least partially enclose the scaffolding member.

10. The brick guard as claimed in claim 5 wherein a radius of curvature of each strut of the pair of struts and/or the hemicylindrical leaf member is less than a radius of curvature of the scaffolding member.

11. The brick guard as claimed in claim 5 wherein the clasp comprises a guide member to guide the scaffolding member into engagement with the clasp.

12. The brick guard as claimed in claim 11 wherein the lower abutting region and the guide member define surfaces converging between the pair of struts and the hemicylindrical leaf member.

13. The brick guard as claimed in claim 11 wherein the lower abutting region and the guide member are shaped to guide the scaffolding member into engagement with the clasp.

14. The brick guard as claimed in claim 11 wherein resilient deformation of the hemicylindrical leaf member and/or the pair of struts enables movement of the lower abutting region and the guide member apart to allow the scaffolding member into engagement with the clasp.

15. The brick guard as claimed in claim 1 wherein the panel has a lattice structure.

16. The brick guard as claimed in claim 15 wherein the positioning of cross-links and/or gaps between cross-links in the lattice structure accommodates integral connector formations on the scaffolding member.

17. The brick guard as claimed in claim 1, wherein the at least one rib is formed from an upper projecting wall, a lower projecting wall, and an outer lateral surface coupling the upper projecting wall and the lower projecting wall, the upper projecting wall or the lower projecting wall formed from a substantially solid surface.

18. The brick guard as claimed in claim 1, wherein the rib comprises upper and lower projecting walls and a lateral surface.

19. The brick guard as claimed in claim 2 wherein the outer surface of the hemicylindrical leaf member is convex and the vanes are provided on the convex outer surface.

* * * * *